US009367996B2

(12) United States Patent
Scalise

(10) Patent No.: US 9,367,996 B2
(45) Date of Patent: Jun. 14, 2016

(54) SYSTEMS AND METHODS FOR ALL IN BETTING ON FANTASY SPORTS

(71) Applicant: Russell Scalise, Chicago, IL (US)

(72) Inventor: Russell Scalise, Chicago, IL (US)

( * ) Notice: Subject to any disclaimer, the term of this patent is extended or adjusted under 35 U.S.C. 154(b) by 0 days.

(21) Appl. No.: 14/453,536

(22) Filed: Aug. 6, 2014

(65) Prior Publication Data

US 2016/0042612 A1 Feb. 11, 2016

(51) Int. Cl.
*G07F 17/32* (2006.01)

(52) U.S. Cl.
CPC ..... *G07F 17/3288* (2013.01); *G07F 17/3244* (2013.01)

(58) Field of Classification Search
USPC ..... 463/25
See application file for complete search history.

(56) References Cited

U.S. PATENT DOCUMENTS

2003/0070178 A1* 4/2003 Boyd ..... G07F 17/32 725/110
2004/0266530 A1* 12/2004 Bishop ..... 463/42
2005/0261043 A1* 11/2005 Slade ..... 463/1
2009/0023495 A1* 1/2009 Koustas et al. ..... 463/25
2009/0026706 A1* 1/2009 St. Clair et al. ..... 273/298
2013/0260898 A1* 10/2013 Pepe et al. ..... 463/42
2013/0337921 A1* 12/2013 Butz et al. ..... 463/42
2014/0018135 A1* 1/2014 Fernandez et al. ..... 463/3
2014/0031105 A1* 1/2014 Givant ..... 463/25
2014/0038683 A1* 2/2014 Oddo et al. ..... 463/17
2014/0038684 A1* 2/2014 Oddo et al. ..... 463/17
2014/0038685 A1* 2/2014 Oddo et al. ..... 463/17
2014/0038700 A1* 2/2014 Oddo et al. ..... 463/25
2014/0128149 A1* 5/2014 Suyat et al. ..... 463/25
2014/0274245 A1* 9/2014 Stickel ..... 463/9
2014/0274411 A1* 9/2014 Moffett ..... 463/42
2014/0302914 A1* 10/2014 Weinstein et al. ..... 463/25

OTHER PUBLICATIONS

"FanDuel: How It Works" published on or before Sep. 1, 2012, and accessible via URL <https://web.archive.org/web/20120901172020/http://www.fanduel.com/how-it-works>, 2 pages.*
"How ScoreStreak Works" published Jun. 19, 2014 and accessible via URL http://www.youtube.com/watch?v=-8WxUVW-L_c.*
"How to Video for ScoreStreak" published Jul. 11, 2014 and accessible via URL <http://www.youtube.com/watch?v=jnF6INZh9Ng>.*
"ScoreStreak: How It Works" published on or before Jul. 1, 2014, and accessible via URL <https://web.archive.org/web/20140701140155/https://scorestreak.com/how_it_works>, 1 page.*
"ScoreStreak: Game Lobby and Picking a Line-Up Walkthrough" published on or before Jun. 19, 2014 and accessible via URL <http://www.youtube.com/watch?v=5_ECJr537D0>.*

(Continued)

*Primary Examiner* — Jason Skaarup
(74) *Attorney, Agent, or Firm* — Sheppard, Mullins, Richter & Hampton LLP

(57) ABSTRACT

Various embodiments described herein provide systems and methods for betting contests relating to sports matches and, in particular, relating to fantasy sports associated with sports matches. For some embodiments, the systems and methods described herein establish and conduct one or more betting contests based on the performance of individual real-world sports players. Additionally, for some embodiments, the performance of an individual real-world sports player is determined using fantasy sports points (hereafter, fantasy points) attributed to the individual real-life sports player by one or more fantasy sports systems.

19 Claims, 7 Drawing Sheets

(56) References Cited

OTHER PUBLICATIONS

"Legality of Daily Fantasy Sports Under Nevada Law" published on or after Oct. 16, 2015 and accessed from URL <http://www.legalsportsreport.com/wp-content/uploads/2015/10/Nevada-AG-DFS.pdf>, 17 pages.*

"Hold'em Betting Rules: No-Limit, Limit, Pot-Limit" published on or before Jan. 11, 2010 and accessed from URL <http://web.archive.org/web/20100111030725/http://www.pokerlistings.com/texas-holdem-betting-rules>, 46 pages.*

"How It Works FanDuel" accessed from URL <https://www.fanduel.com/how-it-works>, 5 pages.*

"How to Play DraftKings" accessed from URL <https://www.draftkings.com/help/how-to-play>, 1 page.*

* cited by examiner

Current Time

Sports Player Performance Outcomes

| $t_0$ | $t_1$ | $t_2$ | $t_3$ | $t_4$ | $t_5$ | | $t_m$ | |
|---|---|---|---|---|---|---|---|---|
| Contest #1 | Contest #2 | Contest #3 | Contest #4 | Contest #5 | Contest #6 | | Contest #m | 400a |
| Sports Matches #1-5 ( 1st = TBD 2nd = TBD 3rd = TBD ) | Sports Matches #6-7 ( 1st = TBD 2nd = TBD 3rd = TBD ) | Sports Matches #8-11 ( 1st = TBD 2nd = TBD 3rd = TBD ) | Sports Matches #11-12 ( 1st = TBD 2nd = TBD 3rd = TBD ) | Event #13-16 ( 1st = TBD 2nd = TBD 3rd = TBD ) | Sports Matches #17-20 ( 1st = TBD 2nd = TBD 3rd = TBD ) | • • • • | Sports Matches #n - p ( 1st = TBD 2nd = TBD 3rd = TBD ) | |

Possible Sports Players Selections

| | | | | | | | | |
|---|---|---|---|---|---|---|---|---|
| QB #1<br>QB #2<br>QB #3<br>QB #4<br>QB #5<br>QB #6<br>QB #7<br>QB #8 | CB #1<br>CB #2<br>CB #3<br>CB #4<br>CB #5<br>CB #6 | WR #1<br>WR #2<br>WR #3<br>WR #4<br>WR #5<br>WR #6<br>WR #7<br>WR #8 | FB #1<br>FB #2<br>FB #3<br>FB #4<br>FB #5<br>FB #6 | TE #1<br>TE #2<br>TE #3<br>TE #4<br>TE #5<br>TE #6<br>TE #7<br>TE #8 | DEF #1<br>DEF #2<br>DEF #3<br>DEF #4<br>DEF #5<br>DEF #6<br>DEF #7<br>DEF #8 | • • • • | K #1<br>K #2<br>K #3<br>K #4<br>K #5<br>K #6<br>K #7<br>K #8 | 402a |

Participant Selections and Wagers

| Ante = 5 | | | | | | | | |
|---|---|---|---|---|---|---|---|---|
| Participant P1 (P1's Wager) | QB#3 (Ante+25) | TBD | TBD | TBD | TBD | TBD | TBD | 404a |
| Participant P2 (P2's Wager) | QB#7 (Ante+50) | TBD | TBD | TBD | TBD | TBD | TBD | |
| Participant P3 (P3's Wager) | QB#2 (Ante+15) | TBD | TBD | TBD | TBD | TBD | TBD | |
| Participant P4 (P4's Wager) | QB#10 (Ante+30) | TBD | TBD | TBD | TBD | TBD | TBD | |
| Participant P5 (P5's Wager) | QB#9 (Ante+40) | TBD | TBD | TBD | TBD | TBD | TBD | |
| Wager Pot | (Ante x 5)+160 | | | | | | | |

Points Accounts

| Initial=100 | | | | | | | | |
|---|---|---|---|---|---|---|---|---|
| Participant P1<br>100 (Init Bal)<br>-5 (Ante)<br>-25 (Wager)<br>70 (New Bal) | | | | | | | | 406a |
| Participant P2<br>100 (Init Bal)<br>-5 (Ante)<br>-50 (Wager)<br>45 (New Bal) | | | | | | | | |
| Participant P3<br>100 (Init Bal)<br>-5 (Ante)<br>-15 (Wager)<br>80 (New Bal) | | | | | | • • • • | | |
| Participant P4<br>100 (Init Bal)<br>-5 (Ante)<br>-30 (Wager)<br>65 (New Bal) | | | | | | | | |
| Participant P5<br>100 (Init Bal)<br>-5 (Ante)<br>-40 (Wager)<br>55 (New Bal) | | | | | | | | |

FIG. 4A

Current Time

Sports Player Performance Outcomes

| $t_0$ | $t_1$ | $t_2$ | $t_3$ | $t_4$ | $t_5$ | | $t_m$ | |
|---|---|---|---|---|---|---|---|---|
| Contest #1 | Contest #2 | Contest #3 | Contest #4 | Contest #5 | Contest #6 | | Contest #*m* | 400b |
| Sports Matches #1-5 ( 1st = QB#3 2nd = QB#10 3rd = QB#7 ) | Sports Matches #6-7 ( 1st = TBD 2nd = TBD 3rd = TBD ) | Sports Matches #8-11 ( 1st = TBD 2nd = TBD 3rd = TBD ) | Sports Matches #11-12 ( 1st = TBD 2nd = TBD 3rd = TBD ) | Event #13-16 ( 1st = TBD 2nd = TBD 3rd = TBD ) | Sports Matches #17-20 ( 1st = TBD 2nd = TBD 3rd = TBD ) | • • • • | Sports Matches #*n* - *p* ( 1st = TBD 2nd = TBD 3rd = TBD ) | |

Possible Sports Players Selections

| | | | | | | | | |
|---|---|---|---|---|---|---|---|---|
| QB #1<br>QB #2<br>QB #3<br>QB #4<br>QB #5<br>QB #6<br>QB #7<br>QB #8 | CB #1<br>CB #2<br>CB #3<br>CB #4<br>CB #5<br>CB #6 | WR #1<br>WR #2<br>WR #3<br>WR #4<br>WR #5<br>WR #6<br>WR #7<br>WR #8 | FB #1<br>FB #2<br>FB #3<br>FB #4<br>FB #5<br>FB #6 | TE #1<br>TE #2<br>TE #3<br>TE #4<br>TE #5<br>TE #6<br>TE #7<br>TE #8 | DEF #1<br>DEF #2<br>DEF #3<br>DEF #4<br>DEF #5<br>DEF #6<br>DEF #7<br>DEF #8 | • • • • | K #1<br>K #2<br>K #3<br>K #4<br>K #5<br>K #6<br>K #7<br>K #8 | 402b |

Participant Selections and Wagers

| *Ante = 5* | | | | | | | | |
|---|---|---|---|---|---|---|---|---|
| Participant P1 *(P1's Wager)* | QB#3 *(Ante+25)* | *TBD* | *TBD* | *TBD* | *TBD* | *TBD* | *TBD* | 404b |
| Participant P2 *(P2's Wager)* | QB#7 *(Ante+50)* | *TBD* | *TBD* | *TBD* | *TBD* | *TBD* | *TBD* | |
| Participant P3 *(P3's Wager)* | QB#2 *(Ante+15)* | *TBD* | *TBD* | *TBD* | *TBD* | *TBD* | *TBD* | |
| Participant P4 *(P4's Wager)* | QB#10 *(Ante+30)* | *TBD* | *TBD* | *TBD* | *TBD* | *TBD* | *TBD* | |
| Participant P5 *(P5's Wager)* | QB#9 *(Ante+40)* | *TBD* | *TBD* | *TBD* | *TBD* | *TBD* | *TBD* | |
| Wager Pot | *(Ante x 5)+160* | | | | | | | |

Points Accounts

| *Initial=100* | | | | | | | | |
|---|---|---|---|---|---|---|---|---|
| Participant P1<br>70 (Old Bal) | 70 (Old Bal)<br>+25 (Ante x 5)<br>+25 (P1's wager)<br>+25 (from P2)<br>+15 (from P3)<br>+25 (from P4)<br>+25 (from P5)<br>210 (New Bal) | | | | | | | 406b |
| Participant P2<br>45 (Old Bal) | 45 (Old Bal)<br>+10<br>(pot remainder)<br>55 (New Bal) | | | | | | | |
| Participant P3 | 80 (Bal) | | | | | • • • • | | |
| Participant P4<br>65 (Old Bal) | 65 (Old Bal)<br>+ 5 (from P2)<br>+ 0 (from P3)<br>+ 5 (P4's wager)<br>+ 5 (from P5)<br>80 (New Bal) | | | | | | | |
| Participant P5 | 55 (Bal) | | | | | | | |

FIG. 4B

Current Time

Sports Player Performance Outcomes

| $t_0$ | $t_1$ | $t_2$ | $t_3$ | $t_4$ | $t_5$ | | $t_m$ |
|---|---|---|---|---|---|---|---|
| Contest #1 | Contest #2 | Contest #3 | Contest #4 | Contest #5 | Contest #6 | | Contest #*m* |
| Sports Matches #1-5 ( 1st = QB#3 2nd = QB#10 3rd = QB#7 ) | Sports Matches #6-7 ( 1st = TBD 2nd = TBD 3rd = TBD ) | Sports Matches #8-11 ( 1st = TBD 2nd = TBD 3rd = TBD ) | Sports Matches #11-12 ( 1st = TBD 2nd = TBD 3rd = TBD ) | Event #13-16 ( 1st = TBD 2nd = TBD 3rd = TBD ) | Sports Matches #17-20 ( 1st = TBD 2nd = TBD 3rd = TBD ) | • • • • | Sports Matches #*n* - *p* ( 1st = TBD 2nd = TBD 3rd = TBD ) |

400c

Possible Sports Players Selections

| | | | | | | | |
|---|---|---|---|---|---|---|---|
| QB #1<br>QB #2<br>QB #3<br>QB #4<br>QB #5<br>QB #6<br>QB #7<br>QB #8 | CB #1<br>CB #2<br>CB #3<br>CB #4<br>CB #5<br>CB #6 | WR #1<br>WR #2<br>WR #3<br>WR #4<br>WR #5<br>WR #6<br>WR #7<br>WR #8 | FB #1<br>FB #2<br>FB #3<br>FB #4<br>FB #5<br>FB #6 | TE #1<br>TE #2<br>TE #3<br>TE #4<br>TE #5<br>TE #6<br>TE #7<br>TE #8 | DEF #1<br>DEF #2<br>DEF #3<br>DEF #4<br>DEF #5<br>DEF #6<br>DEF #7<br>DEF #8 | • • • • | K #1<br>K #2<br>K #3<br>K #4<br>K #5<br>K #6<br>K #7<br>K #8 |

402c

Participant Selections and Wagers

| *Ante* = 5 | | | | | | | |
|---|---|---|---|---|---|---|---|
| Participant P1 (P1's Wager) | QB#3 (Ante+25) | CB#4 (Ante+10) | TBD | TBD | TBD | TBD | TBD |
| Participant P2 (P2's Wager) | QB#7 (Ante+50) | CB#1 (Ante+30) | TBD | TBD | TBD | TBD | TBD |
| Participant P3 (P3's Wager) | QB#2 (Ante+15) | CB#1 (Ante+23) | TBD | TBD | TBD | TBD | TBD |
| Participant P4 (P4's Wager) | QB#10 (Ante+30) | CB#5 (Ante+37) | TBD | TBD | TBD | TBD | TBD |
| Participant P5 (P5's Wager) | QB#9 (Ante+40) | CB#3 (Ante+50) | TBD | TBD | TBD | TBD | TBD |
| Wager Pot | (Ante x 5)+160 | (Ante x 5)+150 | | | | | |

• • • •

404c

Points Accounts

| *Initial=100* | | | | | | | |
|---|---|---|---|---|---|---|---|
| Participant P1 | 210 (Old Bal)<br>-5 (Ante)<br>-10 (Wager)<br>195 (New Bal) | | | | | | |
| Participant P2 | 55 (Old Bal)<br>-5 (Ante)<br>-30 (Wager)<br>20 (New Bal) | | | | | | |
| Participant P3 | 80 (Old Bal)<br>-5 (Ante)<br>-23 (Wager)<br>52 (New Bal) | | | | | | |
| Participant P4 | 80 (Old Bal)<br>-5 (Ante)<br>-37 (Wager)<br>38 (New Bal) | | | | | | |
| Participant P5 | 55 (Old Bal)<br>-5 (Ante)<br>-50 (Wager)<br>0 (New Bal) | | | | | | |

• • • •

406c

FIG. 4C

SYSTEMS AND METHODS FOR ALL IN BETTING ON FANTASY SPORTS

BACKGROUND

1. Technical Field

Various embodiments of the present invention(s) relate to systems and methods for betting contests relating to sports matches and, in particular, relating to fantasy sports associated with sports matches.

2. Description of Related Art

Fantasy sports provide participants the ability to play in daily, weekly, quarterly, season-long and playoff fantasy leagues across various sports, including National Football League (NFL), Major League Baseball (MLB), Major League Soccer (MLS) and the National Hockey League (NHL). Generally, a fantasy sports league (hereafter, fantasy league) is established in connection with a particular real-world professional sports league (e.g., in the U.S., National Football League, Major League Baseball, Major League Soccer), and participants in the fantasy league act as owners a fantasy sports team (hereafter, a fantasy team) that create and manage within the fantasy league. Each fantasy team is composed of real-world players, which are selected by the fantasy team owner from the real-world professional sports league (e.g., NFL, MLB, MLS, NHL, and the like), often regardless of their real-world team affiliations. Once a participant has selected a league, they select the real-world players (e.g., for NFL football, you may select one quarterback, one running back, two wide receivers, one tight end, and one kicker) from the available players in the selected league to be on the participant's fantasy team. Usually, the fantasy league season lasts for the length of the regular season of the real-world professional sports league to which it is associated. During the fantasy league season, the performance of the fantasy team is determined by the real-world performance (e.g., statistical performance, points scored, etc.) of the real-world players on the fantasy team. Since real-world performance of an individual real-world player corresponds to player activity during real-world sports matches, during the fantasy league season, fantasy team owners actively manage their respective fantasy team rosters to maximize the performance their respective fantasy teams derive from the real-world sports matches that occur during the real-world regular sports season. At the end of the fantasy league season, the fantasy teams may be ranked (e.g., based on their respective overall performances) and one or more fantasy team owners may be declared winners of the league.

Unfortunately, traditionally formatted fantasy sports leagues provide little or no opportunity for low-performing fantasy league participants to improve their overall standing once their fantasy team has fallen behind. It is common for fantasy league participants that are not performing too well during a fantasy sports season to lose interest as the fantasy league season progresses. Often, this leads to low-performing fantasy league participants reducing or ceasing their participation in the fantasy league's activities for the remainder of the fantasy league season.

SUMMARY OF EMBODIMENTS

Various embodiments described herein provide systems and methods for betting contests relating to sports matches and, in particular, relating to fantasy sports associated with sports matches. The systems and methods described herein can improve the interest and enjoyment of sports fans, and can improve the active participation of fantasy sports enthusiasts.

For some embodiments, the systems and methods described herein establish and conduct one or more betting contests based on the performance of individual real-world sports players. Additionally, for some embodiments, the performance of an individual real-world sports player is determined using fantasy sports points (hereafter, fantasy points) attributed to the individual real-life sports player by one or more fantasy sports systems (or platforms), such as fantasy sports hosting sites offered by Yahoo®, ESPN®, CBS®, Fox Sports®, and the like. As used herein, a fantasy sports score (hereafter, fantasy score) for an individual real-world sports player can represent the fantasy points that the individual real-world sports player has earned or produced based on their real-world performance during one or more sports matches.

For a given betting contest, each contest participants may select a sports player (e.g., a quarterback) from a set of real-world sports players (e.g., a set of quarterbacks) that will be participating in a set of real-world sports matches (herein after also referred to as sports matches) scheduled to take place over a period of time associated with the given betting contest. Each contest participant may further wager some or all of their points (available in their points account) on the selected sports player performing better than the others in the plurality of real-world sports players. Each wager may include an ante, thereby requiring active participation by each of the participants or otherwise risk being "anted-out" before the end of all the betting contests. Prior the betting contest commencing, the wagers may be collected from each of the contest participants and placed in a wager pot associated with the given betting contest. At the end of a given betting contest, based on the performance of their respective (selected) sports player, each contest participant may win points from the wager pot or lose the points they wager to the wager pot. For some embodiments, a winner is declared based on their respective total points balance at the end of a set of betting contests. For various embodiments, the point payouts from the wager pot to contest participant winners are limited by the wager amounts by those winners.

According to some embodiments, systems and methods establish a first betting contest associated with a plurality of contest participants and a first plurality of sports players scheduled to play in a first set of real-world sports matches over a first time period, where each participant of the plurality of contest participants has associated points in a points account. The first plurality of sports players may comprises sports players of any sports team or any position within a sports team. Alternatively, the first plurality of sports players may comprise sports players of a particular sports team, of a specific team in a sports team (e.g., special teams), or playing a particular position on the sports team. The systems or methods forms, for the first betting contest, a first points wager pot comprising a plurality of first points wagers by the plurality of contest participants on a first plurality of (participant) selected sports players selected from the first plurality of sports players. Each first points wager in the plurality of first points wagers may correspond to one participant of the plurality of contest participants and correspond to one sports player in the first plurality of selected sports player selected by the one participant. The systems or methods may receive, at or after expiration of the first time period, a first plurality of performance metrics relating to the first plurality of selected sports players. The systems or methods may identify, from the plurality of contest participants, a first set of contest participant winners for the first betting contest based on the first plurality of performance metrics (e.g., touchdowns, yards carried, or yards passed by a football player). The systems or methods may update the associated points of each participant of the plurality of contest participants based on the first set of contest participant winners, the plurality of first points wagers, and the first points wager pot.

Depending on the embodiment, each first points wager in the plurality of first points wagers may comprise an ante. The first time period may comprise to a day, a week, a month, or a sports season. Additionally, the first set of real-world sports matches may be associated with football, basketball, baseball, hockey, soccer, golf, or tennis.

When forming the first points wager, for each given participant of the plurality of contest participants, the systems or methods may receive a selection of the one sports player from the first plurality of sports players, thereby including the one sports player as part of the plurality of selected sports players. For each given participant of the plurality of contest participants, the systems or methods may receive from the given participant an instruction for a first points wager on one sports player in the first plurality of selected sports players. For each given participant of the plurality of contest participants, the systems or methods may transfer the first points wager from the associated points of the given participant to the first wager pot.

In some embodiments, the first betting contest is included in a plurality of betting contests associated with the plurality of contest participants and with a plurality of real-world sports matches that includes the set of sports real-world matches, where the plurality of real-world sports matches is scheduled to occur over a second time period that includes the first time period. The systems or methods may identify, from the plurality of contest participants, a set of contest participant winners based on the associated points of each participant of the plurality of pool participants at or after the second time period has expired.

For some embodiments, the method is performed for each betting contest in the plurality of betting contests. For instance, the systems or methods may establish a second betting contest associated with the plurality of contest participants and a second plurality of sports players scheduled to play in a second set of real-world sports matches over a second time period. The second plurality of sports players may comprises sports players of any sports team or any position within a sports team. Alternatively, the second plurality of sports players may comprise sports players of a particular sports team, of a specific team in a sports team (e.g., special teams), or playing a particular position on the sports team. The systems or methods may form, for the second betting contest, a second points wager pot comprising a plurality of second points wagers by the plurality of contest participants on a second plurality of selected sports players selected from the second plurality of sports players. Each second points wager in the plurality of second points wagers may correspond to one participant of the plurality of contest participants and correspond to one sports player in the second plurality of selected sports player selected by the one participant. The systems or methods may receive at or after expiration of the second time period, a second plurality of performance metrics relating to the second plurality of selected sports players. The systems or methods may identify, from the plurality of contest participants, a second set of contest participant winners for the second betting contest based on the second plurality of performance metrics. The systems or methods may update the associated points of each participant of the plurality of contest participants based on the second set of contest participant winners, the plurality of second points wagers, and the second points wager pot. Depending on the embodiment, the second time period may comprise to a day, a week, a month, or a sports season.

The systems or methods may form the second points wager pot before the updating the associated points of each participant of the plurality of contest participants based on the first set of contest participant winners, the plurality of first points wagers, and the first points wager pot. Further, the systems or methods update the associated points of each participant of the plurality of contest participants based on the second set of contest participant winners, the plurality of second points wagers, and the second points wager pot before the updating the associated points of each participant of the plurality of contest participants based on the first set of contest participant winners, the plurality of first points wagers, and the first points wager pot. Depending on the embodiment, each second points wager in the plurality of second points wagers may comprise an ante. In various embodiments, the second time period begins substantially simultaneously to the first time period, the second time period begins before the first time period expires, or the second time period expires before the first time period.

In some embodiments, the set of performance metrics are based on or comprise one or more fantasy points relating to the first plurality of selected sports players. For example, the one or more fantasy points may be provided by one or more fantasy sport system, which may be offered by Yahoo®, CBS®, ESPN®, and the like.

The systems or methods may update the associated points of each participant of the plurality of contest participants based on the first set of contest participant winners, the plurality of first points wagers, and the first points wager pot by transferring points between the first wager pot and associated points of each participant of the plurality of contest participants based on the plurality of first points wagers by the plurality of contest participants.

When updating the associated points, the systems or methods may identify a first place participant winner in the first set of contest participant winners based on a first performance metric of the first plurality of performance metrics corresponding to a first sports player in the plurality of selected sports players selected by the first place participant winner. The systems or methods may update the first wager pot and the associated points of the first place participant winner based on one first points wager in the plurality of first points wagers corresponding to the first place participant winner.

Updating the associated points may comprise identifying a second place participant winner in the first set of contest participant winners based on a second performance metric of the first plurality of performance metrics corresponding to a second sports player in the plurality of selected sports players selected by the second place participant winner. Updating the associated points may further comprise updating the first wager pot and the associated points of the second place participant winner based on one first points wager in the plurality of first points wagers corresponding to the second place participant winner. Updating the associated points may comprise updating the associated points with respect to one or more additional participant winners in the first set of contest participant winners.

For some embodiments, the systems and methods described herein can provide a new format for playing fantasy sports for a fantasy sports season. Depending on the embodiment, this new format can take the place of, or be used in conjunction with, traditional forms of playing fantasy sports (e.g., operating a fantasy sports league).

Additionally, though various embodiments described herein are done so with respect to betting contests or fantasy sports, it will be understood that various embodiments need not be associated with real-world gambling. Indeed, various embodiments described herein can be readily utilized in conducting competition between two or more participants without need for wagering money or items of material value on the competition.

Some embodiments provide for a method that performs various steps and operations described herein, or provide for a computer program product comprising a computer readable medium having computer program code (i.e., executable instructions) executable by a digital processor to perform various steps and operations described herein.

BRIEF DESCRIPTION OF THE DRAWINGS

The drawings are provided for purposes of illustration only and merely depict typical or example embodiments. These drawings are provided to facilitate the reader's understanding and shall not be considered limiting of the breadth, scope, or applicability various embodiments.

FIGS. 4A-4C are diagrams illustrating an example betting contest conducted in accordance with some embodiments.

Figure 1:
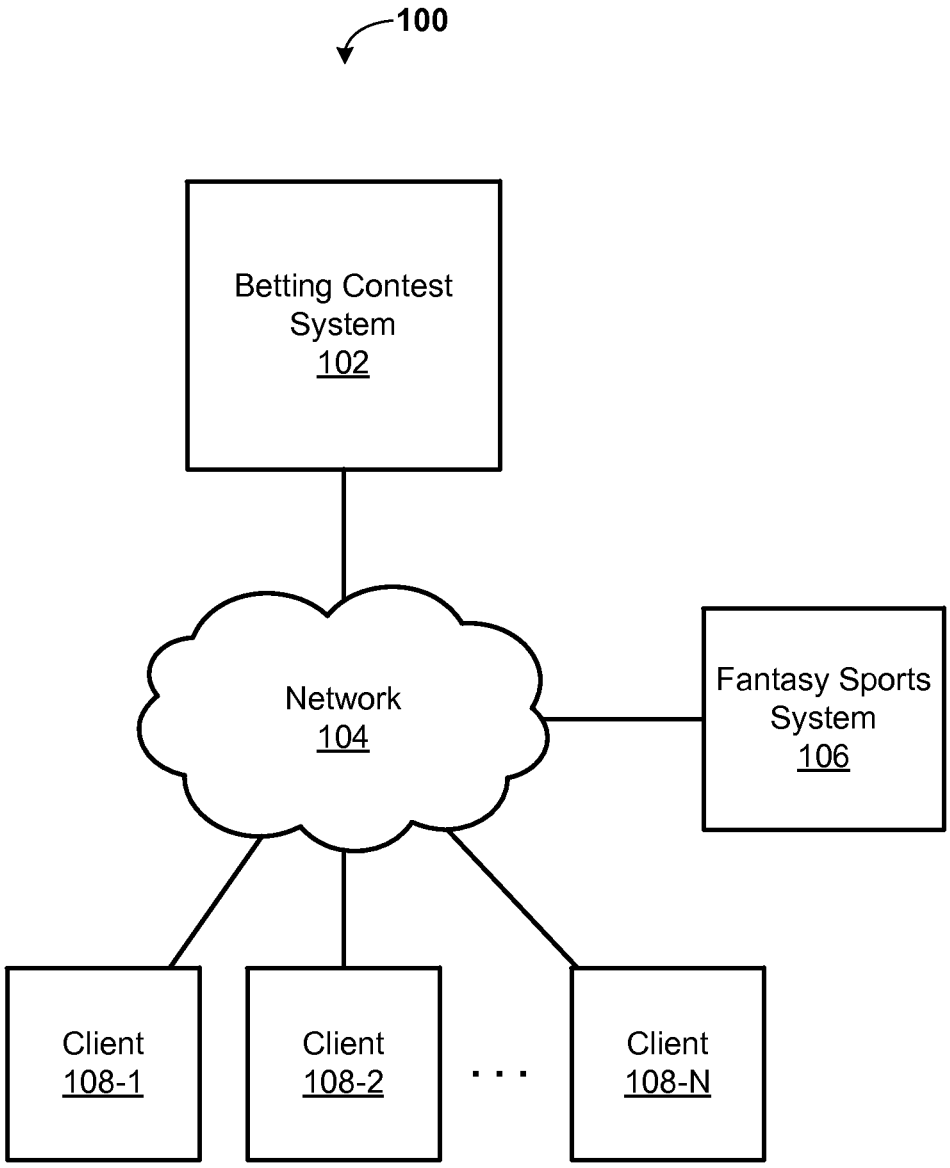
FIG. 1 is a block diagram illustrating an example network system that includes a betting contest system in accordance with some embodiments.

The figures are not intended to be exhaustive or to limit the embodiments to the precise form disclosed. It should be understood that various embodiments may be practiced with modification and alteration.

DETAILED DESCRIPTION OF VARIOUS EMBODIMENTS

Various embodiments described herein provide systems and methods for betting contest and, in particular, conducting betting contests in association with a plurality of real-world sports players scheduled to participate in real-world sports matches, such as exhibition games, regular season games, championships, and the like. In particular embodiments, systems and methods manage or otherwise facilitate a betting contest, for two or more contest participants, where the betting contest is associated with fantasy sports based on real-world sports matches.

For a given betting contest, each contest participants may select a sports player (e.g., a quarterback) from a set of real-world sports players (e.g., a set of quarterbacks) that will be participating in a set of real-world sports matches scheduled to take place over a period of time associated with the given betting contest. Each contest participant may further wager some or all of their points (available in their points account) on the selected sports player performing better than the others in the plurality of real-world sports players (herein also referred to as sports players). Each wager may include an ante, thereby requiring active participation by each of the participants or otherwise risk being "anted-out" before the end of all the betting contests. Prior the betting contest commencing, the wagers may be collected from each of the contest participants and placed in a wager pot associated with the given betting contest. At the end of a given betting contest, based on the performance of their respective (selected) sports player, each contest participant may win points from the wager pot or lose the points they wager to the wager pot. For some embodiments, a winner is declared based on their respective total points balance at the end of a set of betting contests. For various embodiments, the point payouts from the wager pot to contest participant winners are limited by the wager amounts by those winners.

Various embodiments described herein encourage more contest participants to actively participate (e.g., daily or weekly basis) in fantasy sports, particularly those contest participants that are behind in standing within the betting pool (e.g., those contest participants having a low points account balance). Various embodiments allow contest participants to leverage their current standing (e.g., points accounts balance) to manage their risk with respect to each real-world sports player selection associated with the betting contest, which can further enable pool contest to risk it all (e.g., all their points), on any given real-world sports player associated with the betting contest, in order to advance their self in the betting contest standing.

For some embodiments, systems or methods described herein provide a set of betting contests where each betting contest is considered a separate round (i.e., opportunity) for a plurality of contest participants to wager on a plurality of contest participants. For example, with respect to NFL football, systems or methods may provide a set of three betting contests (e.g., rounds), where the first round takes place with respect to Thursday night football, the second round takes place with respect to Sunday morning and afternoon football, and the third (and final) round takes place with respect to Sunday night and Monday night football. Each of these rounds may have an associated points wager pot, and the points won from or lost to a given points wager pot can impact points available for wagering in a subsequent points wager.

In some instances, each contest participant may pay a flat fee to enter the set of betting contests and, in exchange for paying the flat fee, each contest participant will receive a set number of points (initial points balance) from which they can wager points to a wager pot (i.e., "wager" against other contest participants) that is associated with one of the betting contests in the set of betting contests. A contest participant may wager points to the wager pot of a betting contest prior to the commencement of the betting contest. Each contest participant may select a real-life sports player for each betting contest. For example, each contest participant may select one quarterback from a set of quarterbacks scheduled to play during the time period of the betting contest, may select one wide receiver from a set of wide receivers scheduled to play during the time period of the betting contest, or may select one kicker from a set of kickers scheduled to play during the time period of the betting contest. In some embodiments, each contest participant may select five real-life players for a roster for the betting contest—one quarterback, one wide receiver, one tight end, one kicker and one running back. Depending on the embodiment, each contest participant selects the real-life players based on the contest participant's knowledge of the athlete and the athlete's anticipated performance. Prior to each betting contest, contest participants may have the ability to wager some (or all) of their current points balance in connection with the anticipated performance of the contest participant's roster for a given betting contest. At the conclusion of each betting contest, contest participants may earn points for or lose points from their points balance based on the performance of his or her roster during the betting contest.

Prior to the start of the next betting contest, contest participants may be required to wager a minimum ante bet, or wager additional points above and beyond the ante bet. For some embodiments, the number of points a contest participant can wager is limited to the amount of points available in his or her points balance. In some embodiments, at the end of the set of betting contests, the contest participant that has accumulated the highest number of points during the set of betting contests (e.g., three betting contest) is determined to be the winner of the set of betting contests and may receive a prize. Additionally, for some embodiments, a plurality of the contest participants having the highest points balances (e.g., 1st, 2nd, and 3rd highest points balances) are determined to be the winners of the set of betting contests. Further, in some embodiments, a winner is determined at the end of each betting contest based on their points balance, or a set of winner is determined at the end of each betting contest based on their respective points balance.

FIG. 1 is a block diagram illustrating an example network system 100 that includes a betting contest system in accordance with some embodiments. As shown, the example network system 100 comprises a betting contest system 102, a network 104, a fantasy sports system 106, and client 108-1 through client 108-N (hereafter collectively referred to as clients 108). For some embodiments, the network 104 may facilitate data communication between one or more of the betting contest system 102, the fantasy sports system 106, and the clients 108. One or more of the betting contest system 102, the fantasy sports system 106, and clients 108 may be implemented using one or more digital devices, each of which may be similar to the one described and depicted with respect to FIG. 5. Additionally, one or more of the betting contest system 102 or the fantasy sports system 106 may comprise one or more servers, which may be operating on or implemented using one or more cloud-based services (e.g., System-as-a-Service [SaaS]).

The betting contest system 102 may be configured to implement the functions and features of various embodiments described herein. For example, the betting contest system 102 may facilitate the establishment, and subsequent maintenance, of one or more betting contests where each betting contest involves a plurality of contest participants and a plurality of real-world sports players scheduled to play in a set of real-world sports matches (e.g., football, basketball, baseball, hockey, soccer, golf, or tennis) over a time period. The plurality of sports players may comprise sports players of any sports team or any position within a sports team or, alternatively, the plurality of sports players may comprise sports players of a particular sports team, of a specific team in a sports team (e.g., special teams), or playing a particular position on the sports team. The betting contest system 102 may form, for the betting contest, a wager pot comprising a plurality of points wagers by the plurality of contest participants on a plurality of selected sports players that are selected from the plurality of sports players. Each points wager in the plurality of points wagers may correspond to one participant of the plurality of contest participants and correspond to one sports player, in the plurality of selected sports player, selected by the one participant. The betting contest system 102 may receive, at or after expiration of the time period, a plurality of performance metrics relating to the plurality of selected sports players. The betting contest system 102 may identify, from the plurality of contest participants, a set of contest participant winners for the betting contest based on the plurality of performance metrics (e.g., touchdowns, yards carried, or yards passed by a football player). The betting contest system 102 may update the associated points of each participant of the plurality of contest participants based on the set of contest participant winners, the plurality of points wagers, and the points wager pot.

As noted herein, each points wager in the plurality of points wagers may comprise an ante, which may change or remain the same between different betting contests within a set of betting contests (e.g., change to encourage more participation by increasing the risk of being "anted-out"). The time period for the betting contest may comprise to a day, a week, a month, or a sports season.

For some embodiments, when the betting contest system 102 is forming the points wager for the betting contest, the betting contest system 102 may receive a selection of the one sports player from the first plurality of sports players from each given participant of the plurality of contest participants, thereby forming the plurality of selected sports players. For each given participant of the plurality of contest participants, the betting contest system 102 may receive from the given participant an instruction for a points wager on one sports player in the plurality of selected sports players. Additionally, for each given participant of the plurality of contest participants, the betting contest system 102 may transfer the first points wager from the associated points of the given participant to the wager pot.

Before a set of betting contests begin, the betting contest system 102 may initialize each of associated points of the plurality of contest participants with a predetermine amount (e.g., initial balance), such that each contest participant in the betting contest starts with equal standing before the betting contests and its associated plurality of sports matches commence. By accessing the betting contest system 102, each pool participant may wager points, from their respective associated points, on a selected sports player for a given betting contest. For some embodiments, points wagers must occur before the betting contest commences. Additionally, for some embodiments, each participant in the betting contest must provide a minimum points wager for each betting contest in a set of betting contests before they respectively commence. In this way, contest participants must actively participate in the betting contest (e.g., place wagers) or eventually be eliminated from the set of betting contests (e.g., contest participant ends up with a points balance of zero or less than the minimum points wager).

Eventually, the betting contest system 102 receives for a given betting contest the set of performance metrics (e.g., from the fantasy sports system 106) associated with the plurality of selected sports players of the betting contest. Based on the set of performance metrics, the betting contest system 102 can determines a set of contest participant winners (i.e., one or more contest participant winners) for the given betting contest, where the set of contest participant winners selected the highest performing sports players before the commencement of the betting contest. Subsequently, the betting contest system 102 can update the points balance of the associated points of the plurality of contest participants according to the determined set of contest participant winners (e.g., who is 1st, 2nd, and 3rd in the set), the wager pot, and the set of contest participant winners own respective wagers. During the update, points winnings can be transferred from the wager pot to the respective associated points of the set of contest participant winners, and the amounts transferred to the associated points of each contest participant winner may depend on their ranking in the set of contest participant winners.

In some embodiments, the betting contest system 102 limits a contest participant's points wager to the points available in their points account when the first points wager is received. Depending on the embodiment, the betting contest system 102 may permit contest participants to enter a points wager, or change a points wager, for a particular selected sports player associated with the betting contest any time before the betting contest has commenced. Additionally, depending on the embodiment, when the betting contest system 102 is limiting a contest participant's points wager with respect to a selected sports player associated with the betting contest, the betting contest system 102 may take into consideration all points wager still pending for the contest participant, thereby limiting sum of all pending points wagers to the points currently available in the contest participant's points account.

Depending on the embodiment, the betting contest system 102 may be part of larger fantasy sports system (e.g., a fantasy sports website, such as one provided by the NFL, ESPN®, and Yahoo®), whereby the betting contest system 102 enables the larger fantasy sports system to provide an alternative format for playing fantasy sports for a fantasy sports season. The alternative format for playing fantasy sports can take the place of, or be used in conjunction with, traditional forms of playing fantasy sports provided by the larger fantasy sports system.

The fantasy sports system 106 may be configured to provide, with respect to a betting contest managed by the betting contest system 102, a set of actual performance results (e.g., performance metrics) for one or more real-world sports players that are participating in real-world sports matches associated with the betting contest. In particular embodiments, the fantasy sports system 106 provides the betting contest system 102 with the set of actual performance results for real-world sports players in the form of one or more fantasy sports scores for the real-world sports players. The fantasy sports system 106 may provide the betting contest system 102 with the set of performance results for the sports players at or near real-time, and may provide the set of performance results as a data stream of information. In certain embodiments, the fantasy sports system 106 provides a news feed that the betting contest system 102 can use to determine the set of performance results for the sports players. For example, where the betting pool is associated with a plurality of sports matches (e.g., series of baseball games), the fantasy sports system 106 may provide betting contest system 102 with a sports news feed with a set of performance results for the sports players participating in those baseball sports matches. Depending on the embodiments, the set of performance results for the sports players can relate to player statistics or performance of the sports team on which the sports player is a member (e.g., team statistics). One or more components of the fantasy sports system 106 may be implemented by one or more third-party services (e.g., news services) provided in commonly used data formats (e.g., RSS feeds, web services, JSON objects, etc.).

The clients 108 may be any form of computing device capable of receiving user input (e.g., configured to facilitate interaction between a betting pool participant and the betting contest system 102), capable of displaying a client user interface (e.g., configured to facilitate a betting pool participant to access the betting contest system 102), and capable of communicating with the betting contest system 102 over one or more of the communication connections over the network 104. Such computing devices may include a mobile phone, a tablet computing device, a laptop, a desktop computer, personal digital assistant, a portable multi-media player, or any other type of network accessible user device known to those of skill in the art.

Each of the clients 108 may be configured to communicatively connect with the betting contest system 102 and be provided with access to various functionalities provided by the betting contest system 102. For example, by way of one of the clients 108, a user (e.g., as betting pool administrator) may establish a betting contest in association with a plurality of real-world sports players scheduled to participate in real-world sports matches, and a user may join a betting contest as a contest participant. For some embodiments, a user joins the betting contest by paying an entry fee (e.g., buy in for the betting pool). Through one or more of the clients 108, a contest participant may submit for one or more betting contests in a set of betting contests, one or more selected sports players and points wagers on the selected players.

Figure 2:
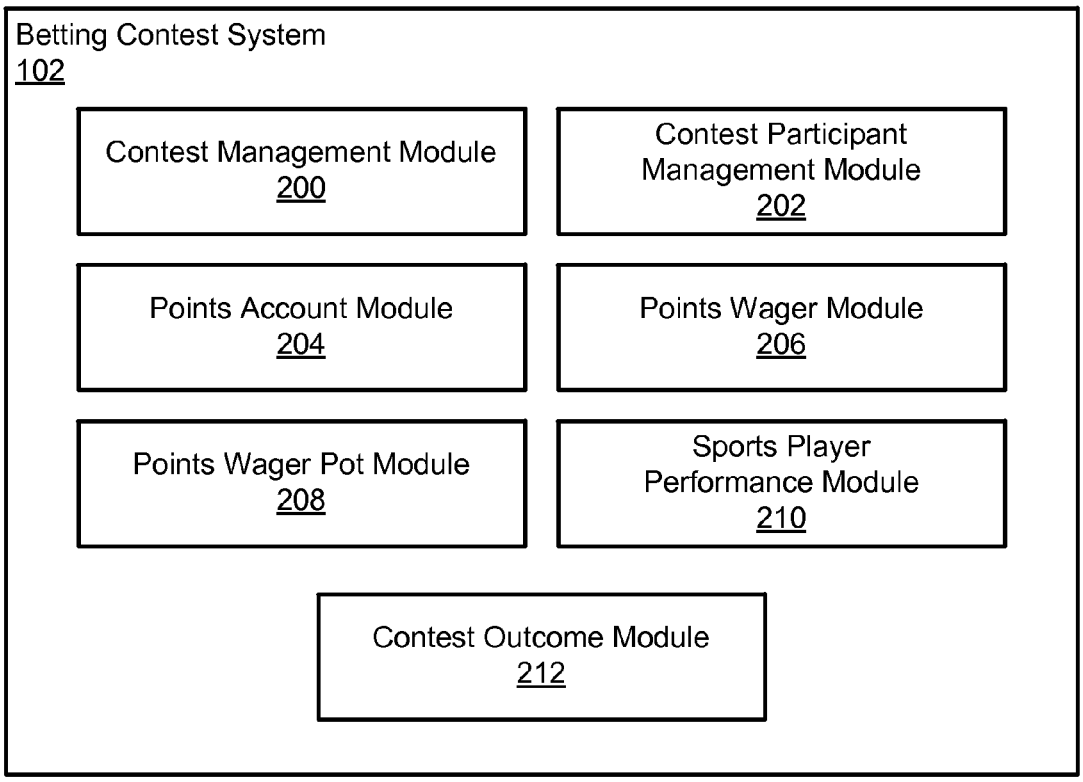
FIG. 2 is a block diagram illustrating an example betting contest system in accordance with some embodiments.

FIG. 2 is a block diagram illustrating an example betting contest system 102 in accordance with some embodiments. In FIG. 2, the betting contest system 102 comprises a contest management module 200, a contest participant management module 202, a points account module 204, a points wager module 206, a points wager pot module 208, a sports player performance module 210, and a contest outcome module 212. Those skilled in the art will appreciate that the composition of the betting contest system 102 may vary between different embodiments. For some embodiments, one or more of the components of the betting contest system 102, such as the contest management module 200, are implemented using a digital device, and that digital device may be similar to the one described and depicted with respect to FIG. 5.

The contest management module 200 may be configured to establish, maintain, or manage one or more betting contests, where each betting contest involves a plurality of contest participants and a plurality of real-world sports players scheduled to play in a set of real-world sports matches (e.g., football, basketball, baseball, hockey, soccer, golf, or tennis) over a time period. The contest management module 200 may enable a contest administrator (e.g., accessing the betting contest system 102 via one of the clients 108) to initiate the creation of a betting contest to be maintained by the betting contest system 102, and to enter the specific parameters of the betting contest. Examples parameters that may be entered for a betting contest can include, without limitation, a name of the betting contest, a real-world sports or real-world sports league to be associated with the betting contest, parameters of selecting real-world sports players (e.g., sports players from only certain sports teams, or sports players playing a certain position on their respective sports team), a set of real-world sports matches in which the real-world sports players will be participating, a plurality of contest participants to be associated with the betting contest (i.e., which users can join the betting contest or set of betting contests), the time period (e.g., duration) for the betting contest, initial points balance for each contest participant, how one or more winners are selected at the end of the betting contest time period, wager settings (e.g., minimum wagers, ante, required participation, etc.), settings relating to how contest participants can interact with the betting contest, and the like. As noted herein, the set of real-world sports players that a contest administrator can select to associate with the betting contest may be predetermined by the betting contest system 102. The plurality of contest participants that the contest administrator associates with the betting contest may be permitted to join when they access the betting contest system 102 (e.g., via one of the client 108), and may further receive a message (e.g., via e-mail) from the betting contest system 102 to inviting them to join the betting contest. For some embodiments, joining the betting contest involves collecting information from candidate contest participant, such as contact information, login information, user preferences, and like, before the candidate contest participant becomes an enrolled contest participant.

The contest participant management module 202 may be configured to facilitate management of contest participants with respect to a betting contest. Functions performed by the contest participant management module 202 may include processes relating to contest participants joining the betting contest, sending invitations to individuals to join the betting contest (e.g., based on the contest administrator's settings), and management of contest participant's preferences. A contest participant's preferences may assist the betting contest system 102 in determining (e.g., auto-generating), for the contest participant, a sports player selection for a betting contest when, for example, the contest participant fails to submit their selection before the commencement of the betting contest. Likewise, the contest participant's preferences may assist the betting contest system 102 in determining (e.g., auto-generating), for the contest participant, a wager for the selected sports player for the betting contest when, for example, the contest participant fails to submit their selection before the commencement of the betting contest. The contest participant's preferences may indicate a default sports player (e.g., always select Peyton Manning) to be selected by the betting contest system 102 for betting contests when the contest participant fails to provide one, and may indicate a default wager (e.g., minimum wager or a predetermined wager higher than the minimum wager) when the contest participant fails to provide one.

The points account module 204 may be configured to manage a plurality of points accounts in association with contest participants associated with a betting contest. In particular, the points account module 204 may maintain a points balance in each points account associated with a contest participant, and may credit or deduct points from the points accounts based on wagers, wager pots, and sets of contest participant winners determined for a betting contests. Such credits and deductions of points may occur as the before the time period of a betting contest commences, or after the time period of a betting contest expires and a set of contest participant winners is determined. In accordance with some embodiments, where a given contest participant is involved more than one betting contest, a contest participant's points account is unique for each betting contest in which the contest participant is involved. With respect to a given betting contest, the points account module 204 is responsible for establishing, initializing, and associating a points account with each contest participant that is associated with the given betting contest.

The points wager module 206 may be configured to manage for a contest participant their selection of sports players and their wagers on selected sports players selected for betting contests. In particular, the points account module 204 may receive sports player selections, sports player selection changes, wagers, or wager changes, for a given betting contest, and may receive such submissions before the given real-world event begins. After a given betting contest has commenced, the points wager module 206 may restrict or prevent the contest participant from modifying their wager with respect to the given betting contest. A wager for a given betting contest may be considered committed once the given betting contest has commenced. When a contest participant submits a wager for the given betting contest, the points wager module 206 may limit such wagers based on the current points balance associated with the contest participant, and may further limit such wagers based on the contest participant's total amount of wagers already committed to other betting contests.

The sports player performance module 210 may be configured to obtain or otherwise receive a set of performance results for participant selected sports players associated with a given betting contest. For some embodiments, the sports player performance module 210 obtains or receives the set of performance results for the selected sports players from two or more different information sources. Examples of information sources can include, without limitation, news feeds, sports new feeds, blogs, organization websites, social media (e.g., Facebook® or Twitter®), and the like. The sports player performance module 210 may use different information sources for based on the type of sports, sports matches, or sports players associated with the betting contest.

The contest outcome module 212 may be configured to identify a set of contest participant winners (i.e., one or more contest participant winners) when a given betting contest has concluded. To do so, the contest outcome module 212 may access and review a set of performance results provided by the sports player performance module 210, and determine a set of contest participants winner based on the parameters of the betting contest (e.g., as defined through the contest management module 200). For some embodiments, the contest outcome module 212 identifies (e.g., declare) one contest participant the winner of the betting contest or may identify two or more contest participants as the winners (e.g., 1st, 2nd, and 3rd place winners). The contest outcome module 212 may further provide a ranking of contest participants at the conclusion of the betting contest, which may be utilized in distributing winnings from a wager pot of a given betting contest.

Figure 3:
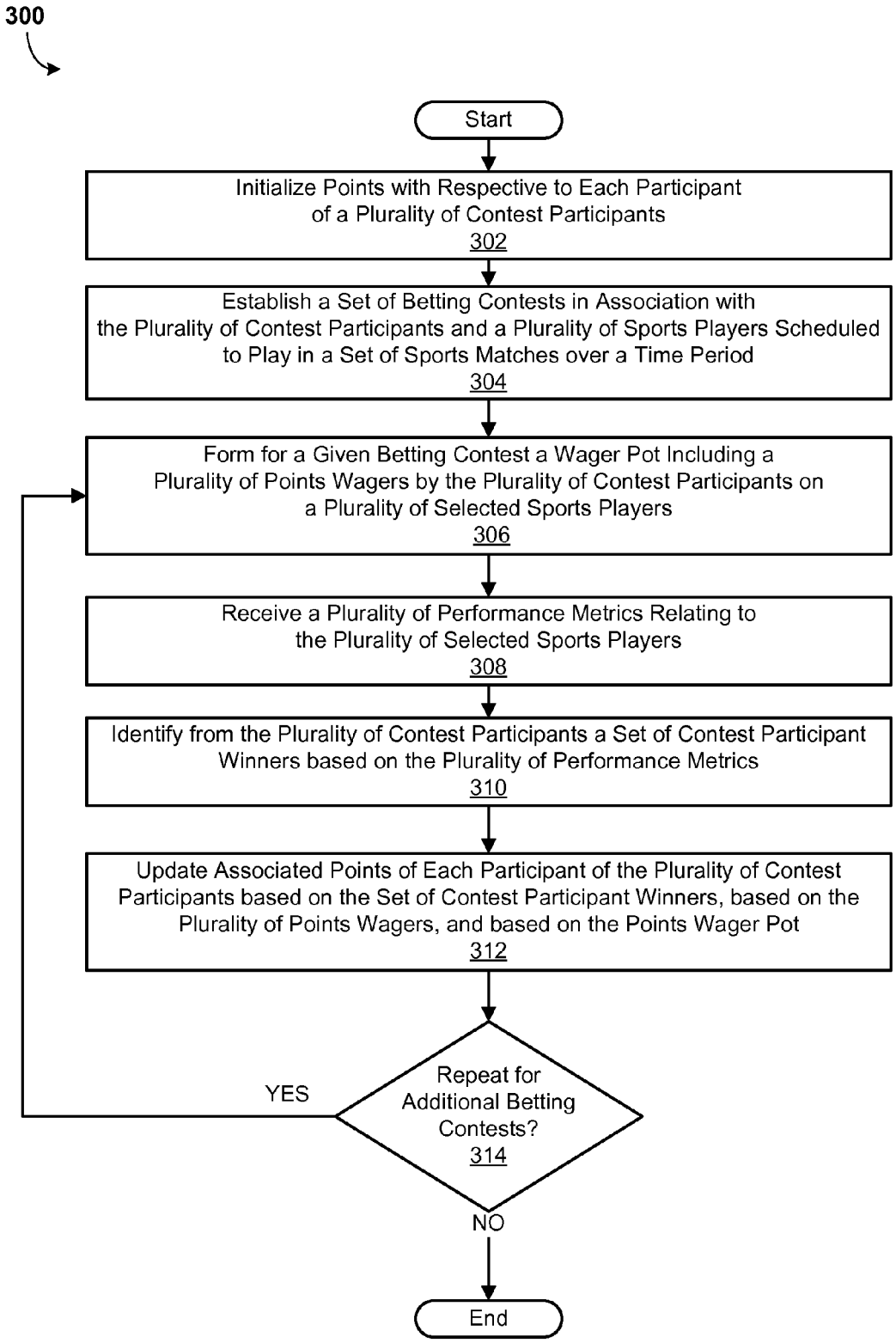
FIG. 3 is a flow diagram illustrating an example betting contest method in accordance with some embodiments.

FIG. 3 is a flow diagram illustrating an example betting contest method 300 in accordance with some embodiments. The method 300 begins at step 302 with the points account module 204 initializing points with respect to each participant of a plurality of contest participants of the betting contest. For some embodiments, a betting contest is associated with a plurality of contest participants, and each contest participant in the plurality of contest participants is associated with a set of points. Depending on the embodiment, the set of points associated with a given contest participant may be maintained in a points account associated with the given contest participant. At step 304, the contest management module 200 may establish a set of betting contests in association with the plurality of contest participants, where each betting contest may be associated with a plurality of sports players scheduled to play in a set of sports matches over a time period. At step 306, the points wager pot module 208 may form a points wager pot for (e.g., in association with) a given betting contest in the set of betting contests (e.g., at least one of the betting contests in the set). For some embodiments, a separate wager pot is formed (e.g., established) for each betting contest in a set of betting contest. A given wager pot may be formed before the commencement of the betting contest to which it is associated. Once formed, the points wager pot may include a plurality of points wagers, by the plurality of contest participants, on a plurality of selected sports players in the plurality of sports players.

At step 308, for the given betting contest, the sports player performance module 210 may receive (or otherwise obtain) a plurality of performance metrics relating to the plurality of selected sports players associated with the given betting contest. Depending on the embodiment, the plurality of performance metrics may be received in one or more separate data transfers, and each data transfer may include the performance metrics of sports players not included in the plurality of selected sports players. For some embodiments, the plurality of performance metrics is received in the form of fantasy points associated with a sports player, and such fantasy sports may be received (or otherwise obtained) from more than one fantasy sports source or system (e.g., Yahoo®, ESPN®, NFL.com, etc.).

At step 310, for the given betting contest, the contest outcome module 212 may identify from the plurality of contest participants a set of contest participant winners based on the plurality of performance metrics received (or obtained) at step 308. At step 312, for the given betting contest, the points account module 204 may update the points associated with each contest participant of the plurality of contest participants based on the set of contest participant winners, based on the plurality of points wagers, and based on the points wager pot. For example, based on the contest outcome module 212 may determine the top three contest participants winners (e.g., 1st, 2nd and 3rd place winners) based on the performance metrics of their respective selected sports players, and those top three contest players collect points from the wager pot according to (e.g., limited by) their respective wager amounts. In particular, the first place winner may collect from the wager pot the maximum amount of points possible based on the first place winner's own wager amount and based on each of the other player's wagers to the wager pot.

At step 314, if there are additional betting contests in the set of betting contests, some or all of the steps 306-312 may be performed with respect to each of those additional betting contests. It will be understand that for some embodiments, the steps of method 300 may be performed in parallel with respect to different betting contests, such as when a first betting contest is established and a second betting contest is established before the first betting contest has commenced or before the first betting contest has ended.

Though the steps of the method 300 may be depicted and described in a certain order, those skilled in the art will appreciate that the order in which the steps are performed may vary between different embodiments. Additionally, those skilled in the art will appreciate that the components described above with respect to the method 300 are merely examples of components that may be used with the method 300, and that other components may also be utilized in some embodiments.

FIGS. 4A-4C are diagrams illustrating an example betting contest conducted in accordance with some embodiments. As described herein, the example betting contest may be associated with a plurality of contest participants, a plurality of real-world sports players playing a set of sports matches, and a wager pot that includes points wagers by each participant of the plurality of pool participants with respect to performance of a plurality of selected sports players selected from the plurality of real-world sports players. In FIGS. 4A-4C, tables 400*a*-400*d* (hereafter collectively referred to as tables 400) provide the top performing sports player during betting contests 1 through m, each of which takes place at corresponding times periods (t0 through tm). In FIGS. 4A-4C, tables 402*a*-402*c* (hereafter collectively referred to as tables 402) depict possible sports players from which contest participants can select and wager during betting contests 1 through m, each of which takes place at corresponding times periods (t0 through tm). Though FIGS. 4A-4C depict that the selection of possible sports players does not change as time periods expire, for some embodiments, the selection of possible sports players for a given betting contest can change before the betting contest commences.

In FIGS. 4A-4C, tables 404*a*-404*c* (hereafter collectively referred to as tables 404) depict each contest participant's sports player selection and wager during betting contests 1 through m, each of which takes place at corresponding times periods (t0 through tm). In FIGS. 4A-4C, tables 406*a*-406*c* (hereafter collectively referred to as tables 406) depict the balance in each of the contest participant points accounts during betting contests 1 through m, each of which takes place at corresponding times periods (t0 through tm). Each of FIGS. 4A-4C illustrates tables 400, 402, 404, and 406 at different time instances, during the betting contests, as the example betting contest is conducted in accordance with various embodiments described herein. For illustrative purposes, the betting contests 1 through m are depicted as starting and ending sequentially with no overlap. For some embodiments, two or more betting contests in a set of betting contests can be conducted concurrently. Additionally, for some embodiments, a given betting contest in a set of betting contests can be established before a previously established betting contest in the set of betting contests has commenced or concluded.

As shown in FIG. 4A, tables 400*a*, 402*a*, 404*a*, and 406*a* are illustrated at a time instance at the beginning of the time period to. In table 400*a*, the top performing sports players for sport matches #1-*p* have yet to be determined. As also illustrated, each betting contest can be associated with more than one sports match. The performance outcomes for a given betting contests 1 through m can be determined based on the performance of the selected sports player during the sports matches associated with a given betting contest.

Table 402*a* illustrates that: for betting contest #1, each of the contest participants can select one quarterback from quarterbacks 1 through 10 (QBs #1-10); for betting contest #2, each of the contest participants can select one cornerback from cornerbacks 1 through 6 (CBs #1-6); for betting contest #3, each of the contest participants can select one cornerback from wide-receivers 1 through 8 (WRs #1-8); for betting contest #4, each of the contest participants can select one fullback from fullbacks 1 through 6 (FBs #1-6); for betting contest #5, each of the contest participants can select one tight end from tight ends 1 through 8 (TEs #1-8); for betting contest #6, each of the contest participants can select one defensive team from defensive teams 1 through 8 (DEFs #1-8); and for betting contest #m, each of the contest participants can select one kicker from kickers 1 through 6 (K#1-6).

Table 404*a* illustrates that for betting contest #1: participant P1 (hereafter, P1) has placed a points wager of 25 points plus the ante for P1's selection of quarterback #3 (QB #3); participant P2 (hereafter, P2) has placed a points wager of 50 points plus the ante for P2's selection of quarterback #7 (QB #7); participant P3 (hereafter, P3) has placed a points wager of 15 points plus the ante for P3's selection of quarterback #2 (QB #2); participant P4 (hereafter, P4) has placed a points wager of 30 points plus the ante for P4's selection of quarterback #10 (QB #10); and participant P5 (hereafter, P5) has placed a points wager of 40 points plus the ante for P5's selection of quarterback #9 (QB #9). Table 404*a* also illustrates that the ante is 5 points, and that the wager pot associated with betting contest #1 is equal to the 160 points plus the five individual antes (i.e., 185 points).

Table 406*a* illustrates that before betting contest #1 commences, each of contest participants points accounts have an initial balance of 100 points. Table 406*a* illustrates that the wagers by contest participants P1 through P5 results in a transfer of points from the individual points accounts of the contest participants to the wager pot associated with betting contest #1. Accordingly, table 406*a* illustrates the adjustments to each of the points accounts after the contest participants respective wagers. As shown, after the transfer, P1's new account balance is 70 points, P2's new account balance is 45 points, P3's new account balance is 80 points, P4's new account balance is 65 points, and P5's new account balance is 55 points.

In FIG. 4B, tables 400*b*, 402*b*, 404*b*, and 406*b* are illustrated at a time instance after time period t0 has concluded and before time period t1 has commenced. As shown in table 400*b*, the top performing sports players for sports match #1 are QB#3 in first place, QB#10 in second place, and QB#3 in third place. In accordance with some embodiments, the top performing sports players for betting contest #1 are determined based on how they performance in comparison over the other sports players selected by the contest participants of betting contest #1. As described herein, the performance of individual sports players may be determined based on their real-world performance metrics (e.g., touchdowns, yards carried, yards lost, etc.), which may comprise or be based on one or more fantasy sports scores from fantasy sports systems (e.g., fantasy sports hosting sites).

Based on performance results of the sports players, contest participants P1, P2, and P4 are determined to be the contest participant winners of betting contest #1 and table 406*b* reflects those contest participant's winnings from the wager pot. In particular, table 406*b* illustrates that for selecting the first place sports player, P1's points account receives from the wager pot all of the ante bets placed by each of the contest participants P1 through P5 for betting contest #1 (i.e., 25 points), P1's own wager to the wager pot for betting contest #1 (i.e., 25 points), and receives a set of points from each of the portions wagered by the contest participants over which P1 prevailed (i.e., contest participants P2 through P5) but the set of points is limited by P1's own wager for betting contest #1 (i.e., 25 points). Accordingly, P1's points account receives the 25 points of ante bets to the wager pot, 25 points from the 25 points wagered to the wager pot by P1, 25 points from the 50 points wagered to the wager pot by P2, 15 points from the 15 points wagered to the wager pot by P3, 25 points from the 30 points wagered to the wager pot by P4, and 25 of the 40 points wagered to the wager pot by P5. This amounts to 140 points. After P1's points account is credited with 140 points from the wager pot of betting contest #1, only 45 points remain in the wager pot for distribution to other winners—25 points remain of P2's wager to the wager pot, 0 points remain of P3's wager to the wager pot, 5 points remain of P4's wager to the wager pot, and 15 points remain of P5's wager to the wager pot.

Table 406*b* also illustrates that for selecting the second place sports player, P4's points account receives a set of points from each of the remaining portions wagered by the contest participants over which P4 prevailed (i.e., contest participants P2, P3, and P5) but the set of points is limited by P4's own wager for betting contest #1 minus his or her losses to other contest participants (i.e., 30 points wagered by P4 minus 25 points to P1=5 points, which is equal to the points remaining of P4's wager to the wager pot). Accordingly, P4's points account receives 5 points from the 25 points remaining of P2's wager to the wager pot, 0 points from the 0 points remaining of P3's wager to the wager pot, 5 points from the 5 points remaining of P4's wager to the wager pot, and 5 points from the 15 points remaining of P5's wager to the wager pot. This amounts to 15 points. After P4's points account is credited with 15 points from the wager pot of betting contest #1, only 30 points remain in the wager pot for distribution to other winners—20 points remain of P2's wager to the wager pot, 0 points remain of P3's wager to the wager pot, 0 points remain of P4's wager to the wager pot, and 10 points remain of P5's wager to the wager pot.

Table 406*b* further illustrates that for selecting the third place sports player, P2's points account receives a set of points remainder of the points in the wager pot. If there were more than three contest participant winners are determined for each betting contest, P2's points account receives a set of points from each of the remaining portions wagered by the contest participants over which P2 prevailed (i.e., contest participants P3 and P5) but the set of points would be limited by P2's own wager for betting contest #1 minus his or her losses to other contest participants (i.e., 50 points wagered by P2 minus 25 points to P1 and 5 points to P4=20 points, which is equal to the points remaining of P2's wager to the wager pot).

In FIG. 4C, tables 400*c*, 402*c*, 404*c*, and 406*c* are illustrated at instance after time period t0 has concluded and before time period t1 has commenced. As shown in table 400*c*, the top performing sports players for sport matches #2-*p* has yet to be determined.

Table 404*c* illustrates that for betting contest #2: participant P1 has placed a points wager of 10 points plus the ante for P1's selection of cornerback #4 (CB #4); participant P2 has placed a points wager of 30 points plus the ante for P2's selection of cornerback #1 (CB #1); participant P3 has placed a points wager of 23 points plus the ante for P3's selection of cornerback #1 (CB #1); participant P4 has placed a points wager of 37 points plus the ante for P4's selection of cornerback #5 (CB #5); and participant P5 has placed a points wager of 50 points plus the ante for P5's selection of cornerback #3 (QB #3). Table 404*c* also illustrates that the ante remains 5 points, and that the wager pot associated with betting contest #2 is equal to the 150 points plus the five individual antes (i.e., 175 points). For some embodiments, the ante may change between different betting contests within a set of betting contests.

As shown in FIG. 4C, in some embodiments, two or more contest participants can select the same sports player from the selection of possible sports player, and may do so as long as there is at least one contest participant in the betting contest selects a different sports player. Where two or more content participants select the same sports player and that sports player wins a top position in the betting contest (e.g., 2nd place), the points winnings from the wager pot can divided amongst the contest participant winner according to their respective wagers minus any losses to other contest participant winners (e.g., to the contest participant winner or winners that selected the 1st place sports player).

Table 406*c* illustrates that before betting contest #2 commences, the wagers by contest participants P1 through P5 results in a transfer of points from the individual points accounts of the contest participants to the wager pot associated with betting contest #2. Accordingly, table 406*c* illustrates the adjustments to each of the points accounts after the contest participants respective wagers. As shown, after the transfer, P1's new account balance is 195 points based on its balance at the time of wager, P2's new account balance is 20 points based on its balance at the time of wager, P3's new account balance is 52 points based on its balance at the time of wager, P4's new account balance is 38 points based on its balance at the time of wager, and P5's new account balance is 0 points based on its balance at the time of wager. As described herein, prior to any wagers to wager pots of betting contests that have yet to begin, the balance of points available in the points account of individual contest participants reflects the points they won or loss during betting contests that have already concluded. As a result, points won from prior betting contests can result provide more points to use in future betting contests.

Figure 5:
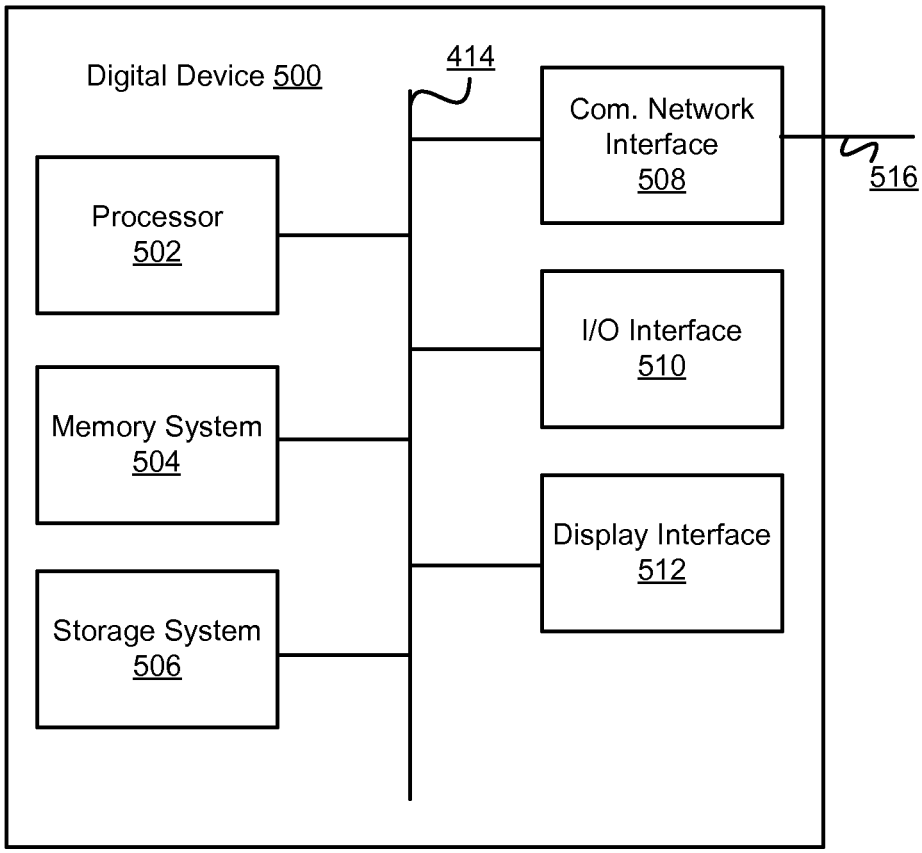
FIG. 5 is a block diagram illustrating an example digital device according to some embodiments.

FIG. 5 is a block diagram illustrating an example digital device 500 according to some embodiments. The digital device 500 comprises a processor 502, a memory system 504, a storage system 506, a communication network interface 508, an I/O interface 510, and a display interface 512 communicatively coupled to a bus 514. The processor 502 may be configured to execute executable instructions (e.g., programs). In some embodiments, the processor 502 comprises circuitry or any processor capable of processing the executable instructions.

The memory system 504 is any memory configured to store data. Some examples of the memory system 504 are storage devices, such as RAM or ROM. The memory system 504 may comprise the RAM cache. In various embodiments, data is stored within the memory system 504. The data within the memory system 504 may be cleared or ultimately transferred to the storage system 506.

The storage system 506 is any storage configured to retrieve and store data. Some examples of the storage system 506 are flash drives, hard drives, optical drives, or magnetic tape. In some embodiments, the digital device 500 includes a memory system 504 in the form of RAM and a storage system 506 in the form of flash data. Both the memory system 504 and the storage system 506 comprise computer readable media that may store instructions or programs that are executable by a computer processor including the processor 502.

The communication network interface (com. network interface) 508 may be coupled to a data network via the link 516. The communication network interface 508 may support communication over an Ethernet connection, a serial connection, a parallel connection, or an ATA connection, for example. The communication network interface 508 may also support wireless communication (e.g., 802.11 a/b/g/n, WiMAX). It will be apparent to those skilled in the art that the communication network interface 508 may support many wired and wireless standards.

The optional input/output (I/O) interface 510 is any device that receives input from the user and output data. The optional display interface 512 is any device that may be configured to output graphics and data to a display. In one example, the display interface 512 is a graphics adapter.

It will be appreciated by those skilled in the art that the hardware elements of the digital device 500 are not limited to those depicted in FIG. 5. A digital device 500 may comprise more or less hardware elements than those depicted. Further, hardware elements may share functionality and still be within various embodiments described herein. In one example, encoding or decoding may be performed by the processor 502 or a co-processor located on a GPU.

One or more functions may be stored on a storage medium such as a computer readable medium. The instructions can be retrieved and executed by a processor. Some examples of instructions are software, program code, and firmware. Some examples of storage medium are memory devices, tape, disks, integrated circuits, and servers. The instructions are operational when executed by the processor to direct the processor to operate in accord with some embodiments. Those skilled in the art are familiar with instructions, processor(s), and storage medium.

As used herein, the term "set" may refer to any collection of elements, whether finite or infinite. The term subset may refer to any collection of elements, wherein the elements are taken from a parent set; a subset may be the entire parent set. The term proper subset refers to a subset containing fewer elements than the parent set.

Additionally, it will be appreciated that a "module" may comprise software, hardware, firmware, and/or circuitry. In one example one or more software programs comprising instructions capable of being executable by a processor may perform one or more of the functions of the modules described herein. In another example, circuitry may perform the same or similar functions. Alternative embodiments may comprise more, less, or functionally equivalent modules and still be within the scope of present embodiments. For example, the functions of the various modules may be combined or divided differently.

Throughout the entirety of the present disclosure, use of the articles "a" or "an" to modify a noun may be understood to be used for convenience and to include one, or more than one of the modified noun, unless otherwise specifically stated.

Various embodiments are described herein as examples. It will be apparent to those skilled in the art that various modifications may be made and other embodiments can be used.

We claim:

1. A method comprising:

establishing, by a computer system, a first betting contest associated with a plurality of contest participants and a first plurality of sports players scheduled to play in a first set of real-world sports matches over a first time period, each contest participant of the plurality of contest participants having associated points in a points account;

receiving, by the computer system, from a first contest participant of the first betting contest, a first points wager amount from the associated points of the first contest participant, the first points wager amount corresponding to performance of at least a first selected set of sports players during the first time period, the first selected set of sports players selected from the first plurality of sports players by the first contest participant;

receiving, by the computer system, from a second contest participant of the first betting contest, a second points wager amount from the associated points of the second contest participant, the second points wager amount corresponding to performance of at least a second selected set of sports players during the first time period, the second points wager amount being greater than the first points wager amount, the second selected set of sports players selected from the first plurality of sports players by the second contest participant and the second selected set of sports players being different than the first selected set of sports players;

forming, by the computer system, for the first betting contest, a first points wager pot comprising a first plurality of points wager amounts received from the plurality of contest participants, the first plurality of points wager amounts including at least the first points wager amount and the second points wager amount;

receiving, by the computer system, at or after expiration of the first time period, a first plurality of performance metrics relating to performance of the first plurality of sports players during the first time period;

identifying, by the computer system, from the plurality of contest participants, a first set of contest participant winners for the first betting contest based on the first plurality of performance metrics, the first set of contest participant winners including a first place winner; and updating, by the computer system, when the first contest participant is the first place winner, the associated points of the first contest participant to include at least a portion of the second points wager amount that is no greater than the first points wager amount.

2. The method of claim 1, wherein the forming the first points wager pot comprises transferring the first plurality of points wager amounts received from the plurality of contest participants to the first points wager pot.

3. The method of claim 2, wherein each points wager amount from the first plurality of points wager amounts corresponds to one contest participant of the plurality of content participants and corresponds to performance of a selected set of sports players from the first plurality of sports players during the first time period, the selected set of sports players selected from the first plurality of sports players by the one contest participant corresponding to the points wager amount.

4. The method of claim 1, wherein each points wager amount of the first plurality of points wager amounts comprises an ante.

5. The method of claim 1, further comprising:

establishing a second betting contest associated with the plurality of contest participants and a second plurality of sports players scheduled to play in a second set of real-world sports matches over a second time period;

forming, for the second betting contest, a second points wager pot comprising a second plurality of points wager amounts received from the plurality of contest participants, each points wager amount from the second plurality of points wager amounts corresponding to one contest participant of the plurality of contest participants and corresponding to performance of a selected set of sports players from the second plurality of sports players during the second time period, the selected set of sports players selected from the second plurality of sports players by the one contest participant corresponding to the points wager amounts;

receiving, at or after expiration of the second time period, a second plurality of performance metrics relating to the second plurality of sports players;

identifying, from the plurality of contest participants, a second set of contest participant winners for the second betting contest based on the second plurality of performance metrics; and updating the associated points of each contest participant of the plurality of contest participants based on the second set of contest participant winners, the second plurality of points wager amounts, and the second points wager pot.

6. The method of claim 5, wherein the forming the second points wager pot occurs before the identifying, from the plurality of contest participants, the first set of contest participant winners.

7. The method of claim 5, wherein the updating the associated points of each contest participant of the plurality of contest participants based on the second set of contest participant winners, the second plurality of points wagers, and the second points wager pot occurs before the identifying, from the plurality of contest participants, the first set of contest participant winners.

8. The method of claim 5, wherein each points wager amount of the second plurality of points wager amounts comprises an ante.

9. The method of claim 5, wherein the second time period begins substantially simultaneously to the first time period, the second time period begins before the first time period expires, or the second time period expires before the first time period.

10. The method of claim 1, wherein the set of performance metrics is based on or comprises one or more fantasy points relating to the first plurality of sports players.

11. The method of claim 1, wherein the first set of real-world sports matches is associated with football, basketball, baseball, hockey, soccer, golf, or tennis.

12. The method of claim 1, wherein the first time period comprises a day, a week, a month, or a sports season.

13. The method of claim 1, wherein the first betting contest is included in a plurality of betting contests associated with the plurality of contest participants and with a plurality of real-world sports matches that includes the first set of real-world sports matches, the plurality of real-world sports matches being scheduled to occur over a second time period that includes the first time period.

14. The method of claim 13, wherein the method is performed for each betting contest in the plurality of betting contests.

15. The method of claim 13, wherein the second time period comprises a day, a week, a month, or a sports season.

16. The method of claim 13, further comprising identifying, from the plurality of contest participants, a set of contest participant winners based on the associated points of each contest participant of the plurality of contest participants at or after the second time period has expired.

17. The method of claim 1, wherein the updating the associated points of the first contest participant comprises transferring points from the first points wager pot to the associated points of the first contest participant based on the first points wager amount.

18. A system comprising:

a computer system;

means for causing the computer system to establish a first betting contest associated with a plurality of contest participants and a first plurality of sports players scheduled to play in a first set of real-world sports matches over a first time period, each contest participant of the plurality of contest participants having associated points in a points account;

means for receiving, from a first contest participant of the first betting contest, a first points wager amount from the associated points of the first contest participant, the first points wager amount corresponding to performance of at least a first selected set of sports players during the first time period, the first selected set of sports players selected from the first plurality of sports players by the first contest participant;

means for receiving, from a second contest participant of the first betting contest, a second points wager amount from the associated points of the second contest participant, the second points wager amount corresponding to performance of at least a second selected set of sports players during the first time period, the second points wager amount being greater than the first points wager amount, the second selected set of sports players selected from the first plurality of sports players by the second contest participant and the second selected set of sports players being different than the first selected set of sports players;

means for forming, for the first betting contest, a first points wager pot comprising a first plurality of points wager amounts received from the plurality of contest participants, the first plurality of points wager amounts including at least the first points wager amount and the second points wager amount;

means for receiving, at or after expiration of the first time period, a first plurality of performance metrics relating to performance of the first plurality of sports players during the first time period;

means for identifying, from the plurality of contest participants, a first set of contest participant winners for the first betting contest based on the first plurality of performance metrics, the first set of contest participant winners including a first place winner; and means for updating the associated points of the first contest participant to include at least a portion of the second points wager amount that is no greater than the first points wager amount when the first contest participant is the first place winner.

19. A system comprising:

a processor; and a memory storing instructions configured to instruct the processor to perform the operations of:

establishing a first betting contest associated with a plurality of contest participants and a first plurality of sports players scheduled to play in a first set of real-world sports matches over a first time period, each contest participant of the plurality of contest participants having associated points in a points account;

receiving, from a first contest participant of the first betting contest, a first points wager amount from the associated points of the first contest participant, the first points wager amount corresponding to performance of at least a first selected set of sports players during the first time period, the first selected set of sports players selected from the first plurality of sports players by the first contest participant;

receiving, from a second contest participant of the first betting contest, a second points wager amount from the associated points of the second contest participant, the second points wager amount corresponding to performance of at least a second selected set of sports players during the first time period, the second points wager amount being greater than the first points wager amount, the second selected set of sports players selected from the first plurality of sports players by the second contest participant and the second selected set of sports being different than the first selected set of sports players;

forming, for the first betting contest, a first points wager pot comprising a first plurality of points wager amounts received from the plurality of contest participants, the first plurality of points wager amounts including at least the first points wager amount and the second points wager amount;

receiving, at or after expiration of the first time period, a first plurality of performance metrics relating to performance of the first plurality of sports players during the first time period;

identifying, from the plurality of contest participants, a first set of contest participant winners for the first betting contest based on the first plurality of performance metrics, the first set of contest participant winners including a first place winner; and updating the associated points of the first contest participant to include at least a portion of the second points wager amount that is no greater than the first points wager amount when the first contest participant is the first place winner.

* * * * *